United States Patent [19]

Nagase

[11] 3,991,436

[45] Nov. 16, 1976

[54] BUTT HINGE WITH MEANS TO PREVENT THE WEAR OF KNUCKLES

[75] Inventor: Mitsuo Nagase, Kurobe, Japan

[73] Assignee: Yoshida Kogyo K.K., Japan

[22] Filed: May 6, 1975

[21] Appl. No.: 574,924

[30] Foreign Application Priority Data

May 8, 1974 Japan ..... 49-51997

[52] U.S. Cl. ..... 16/136; 16/191

[51] Int. Cl.[2] ..... E05D 11/04

[58] Field of Search ..... 16/128 R, 136, 135, 16/168, 169, 137, 149, 158, 191

[56] References Cited

UNITED STATES PATENTS

| | | | |
|---|---|---|---|
| 137,623 | 4/1973 | Rankin | 16/136 |
| 1,180,192 | 4/1916 | Rowe | 16/169 |
| 1,203,114 | 10/1916 | Hurd | 16/169 |
| 2,930,075 | 3/1960 | Deutchman et al. | 16/191 |
| 2,990,572 | 7/1961 | Schwartzberg | 16/191 |
| 3,178,762 | 4/1965 | Whiting | 16/191 |
| 3,602,942 | 9/1971 | Neff et al. | 16/191 |

*Primary Examiner*—G. V. Larkin

*Attorney, Agent, or Firm*—Hill, Gross, Simpson, Van Santen, Steadman, Chiara & Simpson

[57] ABSTRACT

To prevent the wear of, and noise production by, the opposed or abutting ends of knuckles on a pair of hinge leaves, a pair of rings of wear resisting material are interposed between the opposed ends of each two adjacent knuckles, with a pintle passing through the knuckles and rings. The rings have pairs of fingers gripping the opposed marginal edges of the leaves, respectively, so that the paired rings rotate relative to each other with the swinging movement of the leaves. Each ring with its pair of fingers is exactly flat and is therefore manufacturable by punching from sheet metal, plastic or the like.

1 Claim, 3 Drawing Figures

BUTT HINGE WITH MEANS TO PREVENT THE WEAR OF KNUCKLES

BACKGROUND OF THE INVENTION

Field of the Invention

This invention relates generally to hinges or butt hinges, and more specifically to improved means to prevent the wear of the abutting or opposed ends of pintle-receiving knuckles on the leaves of a butt hinge.

Prior Art

The leaves of a butt hinge in general use have interfitting, axially aligned knuckles along their opposed marginal edges for receiving a pintle or pin therethrough, so that the leaves are swingable one with respect to the other on the pintle. In this type of hinge the abutting ends of the knuckles are highly susceptible to wear and noise production due to frictional forces exerted thereon in the use of the hinge.

There have been known some antifriction means designed to eliminate the above noted defect of butt hinges. Japanese Utility Model Publication No. 48-4607 discloses a typical example of such means, which comprises a pair of plastic rings mounted between the opposed ends of each two adjacent knuckles. Each ring has an integral pin projecting into an internal recess in the knuckle with which the ring is in contact. This prior art means, however, is not truly simple in configuration or easy and economical to manufacture as compared with the means of the instant invention.

SUMMARY OF THE INVENTION

It is an object of this invention to provide highly simplified, inexpensive and easily manufacturable means adapted to be readily installed in position to prevent the wear, of and the production of noise by, the opposed ends of knuckles on the leaves of a butt hinge.

Briefly, the invention relates to a pair of rings of wear resisting material which are installed between the opposed ends of each two adjacent knuckles of a hinge so as to receive the usual pintle therethrough. Each ring has a pair of fingers formed integral therewith in coplanar relationship. The fingers of the paired rings straddle or embrace the opposed adjacent edges of the hinge leaves respectively.

Since the rings with their fingers are of absolutely planar configuration, they are easily and inexpensively mass-producible by punching sheet metal, plastic or like wear-resisting material. Another advantage of the invention resides in the ease of assemblage of a complete hinge, as the planar rings are readily installable between the aligned knuckles of the two leaves. Although the rings may first be installed displaced in the axial direction of the knuckles, they can be readily slid into position along the opposed edges of the leaves, as there is no opening with which the fingers must register.

The features which are believed to be novel and characteristic of this invention are set forth in particular in the claims appended hereto. The invention itself, however, both as to its organization and manner of functioning, together with the further objects and advantages thereof, will become clear as the description proceeds, with reference had to the accompanying drawings in which like reference numerals refer to like parts throughout the several views.

DESCRIPTION OF THE PREFERRED EMBODIMENT

Figure 2:
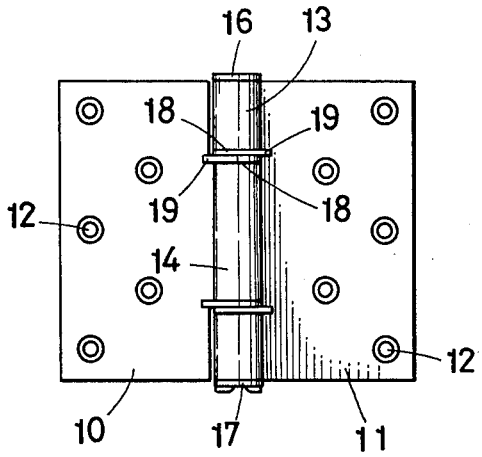
FIG. 2 is a front elevational view showing the hinge of FIG. 1 in completely assembled form.

A butt hinge has a pair of rectangular leaves 10 and 11 having screw holes 12 of suitable construction and relative placement. The leaf 10 has a pair of axially aligned, spaced knuckles 13, 13 along its marginal edge opposed to the corresponding edge of the other leaf 11. These knuckles 13 are adapted to receive therebetween a knuckle 14 on the opposed edge of said other leaf 11. The knuckle 14 is somewhat shorter in length than the usual space between the knuckles 13, 13. The knuckles 13 and 14 on both leaves are thus interfittable in axial alignment. The leaves 10 and 11 with their knuckles 13 and 14 may each be an integral aluminum extrusion.

The axially aligned knuckles 13 and 14 receive the shank portion of a pintle 15 having a head 16. A retainer ring 17 retains the pintle 15 within the knuckles 13 and 14.

According to the invention, a pair of rings 18 is interposed between each of the opposed ends of the adjacent knuckles 13 and 14. These rings 18 are made of wear resisting material such as stainless steel or other hard metal or plastic. Each ring corresponds in shape and size to the cross section of the knuckle 13 or 14 and has a pair of parallel spaced fingers 19 that are arranged in slight displacement from the diameter of the ring. The pair of fingers 19 has a sufficient spacing to receive the knuckle-carrying marginal edge of the leaf 10 or 11 and is in coplanar relationship to the ring 18.

Figure 3:
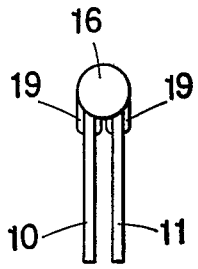
FIG. 3 is a top plan view of the hinge of FIGS. 1 and 2.
Figure 1:
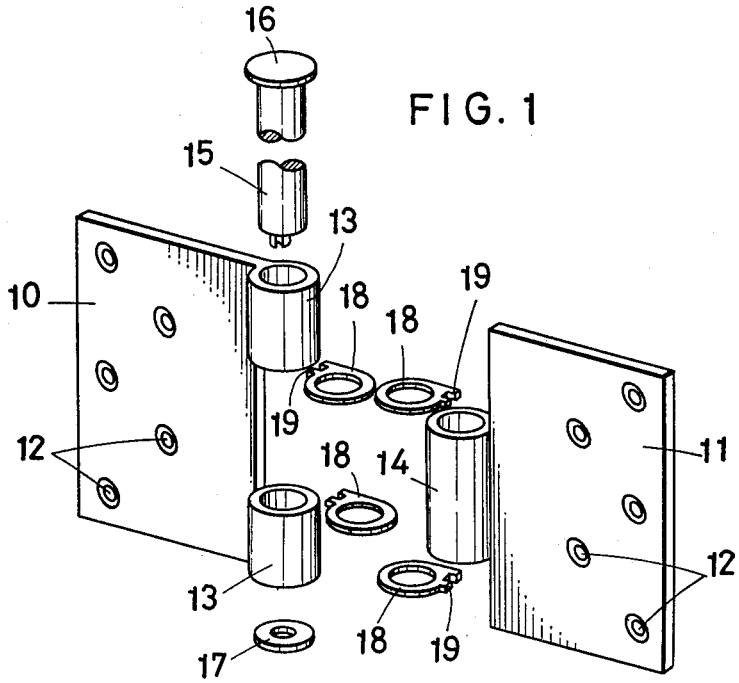
FIG. 1 is an exploded perspective view of a butt hinge incorporating the improved means of this invention.

For the assemblage of the above identified hinge parts into the form shown in FIGS. 2 and 3, the pair of rings 18 are interposed between the opposed ends of each two adjacent ones of the interfitted knuckles 13 and 14, and with the knuckle 14, fill the space between the knuckles 13. The pairs of fingers 19 of the respective rings 18 straddle or embrace the opposed edges of the respective leaves 10 and 11. The pintle 15 is then inserted into the aligned knuckles 13 and 14 and rings 18 and is secured by the retainer ring 17.

Since the fingers 19 of each pair of rings 18 grip the respective leaves 10 and 11, the rings rotate in sliding contact with each other with the swinging movement of the leaves. No frictional force is therefore exerted on the opposed ends of the knuckles 13 and 14, and no aperture is needed in either leaf for any finger.

The improved means of this invention has been described hereinbefore as adapted for the particular hinge shown. However, since numerous modifications and changes will readily occur to those skilled in the art, it is not desired to limit the invention to the exact construction shown and described. The invention, instead, should be construed to be inclusive of all suitable modifications and equivalents falling within the scope of the following claim.

What is claimed is:

1. A hinge comprising in combination:

a. a pair of leaves, one of which has at least one knuckle along a marginal edge thereof, and the other of which has at least two spaced knuckles along an adjacent marginal edge, said knuckles being apertured and axially aligned, the space between said two knuckles being substantially greater than the length of said one knuckle;

b. a pintle extending through said knuckles; and c. a pair of wear rings surrounding said pintle at each end of said one knuckle, and such four wear rings, with said one knuckle, substantially filling said space, each of said wear rings having a pair of fingers straddling that one of said leaves whose knuckle it engages.

* * * * *